US005749292A

United States Patent [19]

De Bastiani et al.

[11] Patent Number: 5,749,292

[45] Date of Patent: May 12, 1998

[54] RELIEF DECORATING OF CERAMIC ARTICLES USING SCREEN PRINTING PROCESSES

[75] Inventors: Norman P. De Bastiani, So Hadley; Richard R. Carlson, Worcester, both of Mass.

[73] Assignee: Chartpak, Inc., Leeds, Mass.

[21] Appl. No.: 719,766

[22] Filed: Sep. 25, 1996

[51] Int. Cl.[6] ..... B41M 1/12

[52] U.S. Cl. ..... 101/129; 156/89; 156/240; 101/34; 101/35

[58] Field of Search ..... 101/129, 33, 34, 101/35; 156/239, 89, 240

[56] References Cited

U.S. PATENT DOCUMENTS

| | | | |
|---|---|---|---|
| 2,267,787 | 12/1941 | Ciavola | 101/129 |
| 2,283,286 | 2/1942 | Porth | 264/251 |
| 2,520,992 | 9/1950 | Axelrod | 101/129 |
| 2,779,270 | 1/1957 | Hill | 101/129 |
| 2,832,695 | 4/1958 | Compton et al. | 156/89 |
| 3,031,324 | 4/1962 | Jankowski | 101/129 |
| 3,432,328 | 3/1969 | Vaurio | 101/129 |
| 3,442,207 | 5/1969 | Johnson | 101/129 |
| 3,795,189 | 3/1974 | Jaffa | 101/123 |
| 3,857,746 | 12/1974 | Blanco et al. | 101/129 |
| 4,038,123 | 7/1977 | Sammis | 156/240 |
| 4,084,506 | 4/1978 | Nakatani | 101/127 |
| 4,135,020 | 1/1979 | Maxwell | 428/131 |
| 4,324,815 | 4/1982 | Mitani et al. | 101/129 |
| 4,678,531 | 7/1987 | Metzger et al. | 156/250 |
| 4,791,006 | 12/1988 | Galvagni et al. | 427/282 |
| 4,854,230 | 8/1989 | Niki et al. | 101/123 |
| 4,930,413 | 6/1990 | Jaffa | 101/126 |
| 5,593,080 | 1/1997 | Teshima et al. | 101/127 |

*Primary Examiner*—Edgar S. Burr
*Assistant Examiner*—Leslie Grohusky
*Attorney, Agent, or Firm*—Schweitzer Cornman Gross & Bondell LLP

[57] ABSTRACT

A process for a production basis relief decorating of ceramic articles. In place of conventional, manual application of relief features, the process provides for a special technique for screen printing of relief features onto the surface of a transfer decal sheet, typically a decal sheet that has previously been printed with a conventional, two-dimensional primary design. The new process includes a screen printing stencil of unusual thickness, at least 0.015" and up to as much as 0.125", characterized by having unrestricted non-convergent through openings. Ceramic inks are formulated to heavy viscosity, having a characteristic comparable to peanut butter, with a viscosity in excess of one million cps. The ink is flow resistant in character, and is forced through the stencil openings by a slow-moving squeegee. The squeegee action is such as to provide increased dwell time of the ink with the surface of the transfer decal paper, before lifting of the stencil. The printed design is transferred to a ceramic article from the decal sheet, and is then fused to the ceramic article by kiln firing in the usual way. The relief design elements stand out prominently in three dimensions on the ceramic article. Extraordinary production economies can be realized by the practice of the invention.

21 Claims, 5 Drawing Sheets

FIG. 1
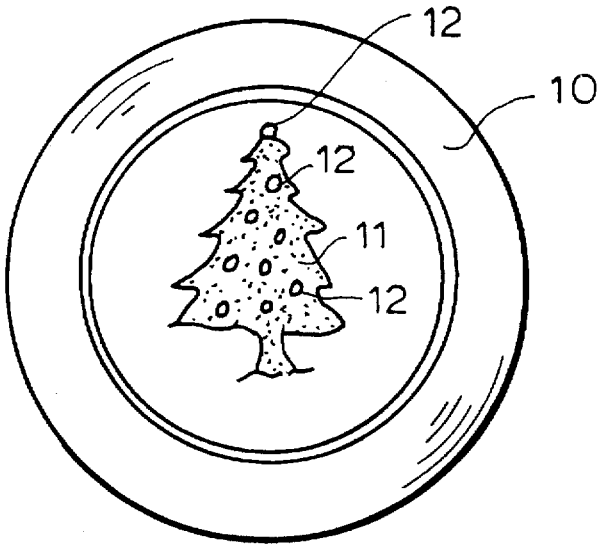
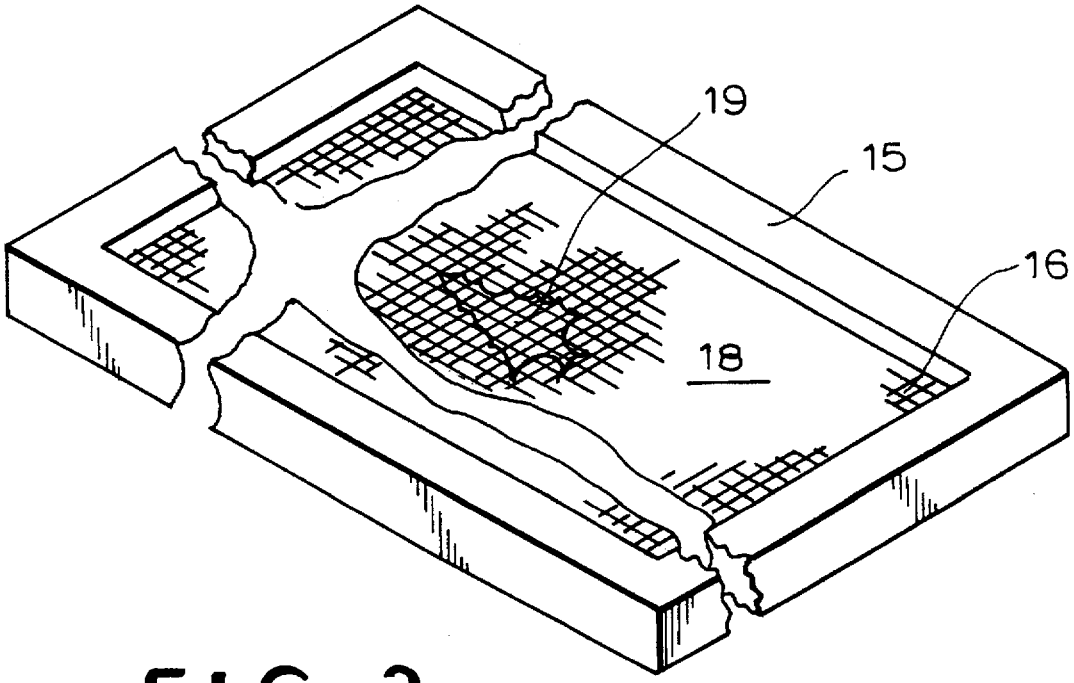
FIG. 2

FIG. 3
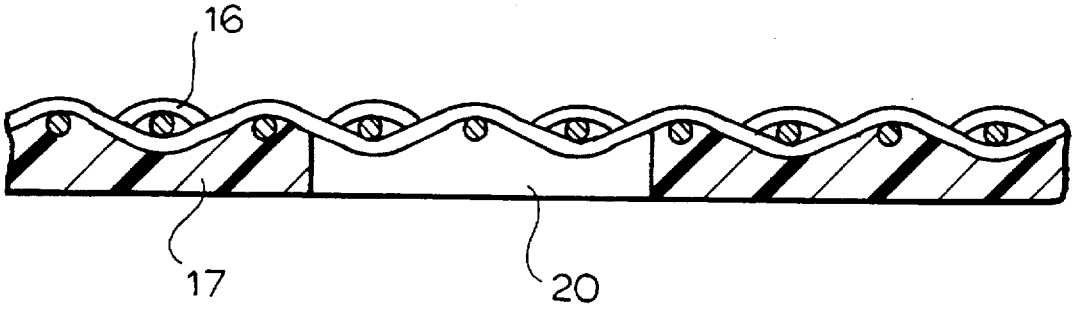
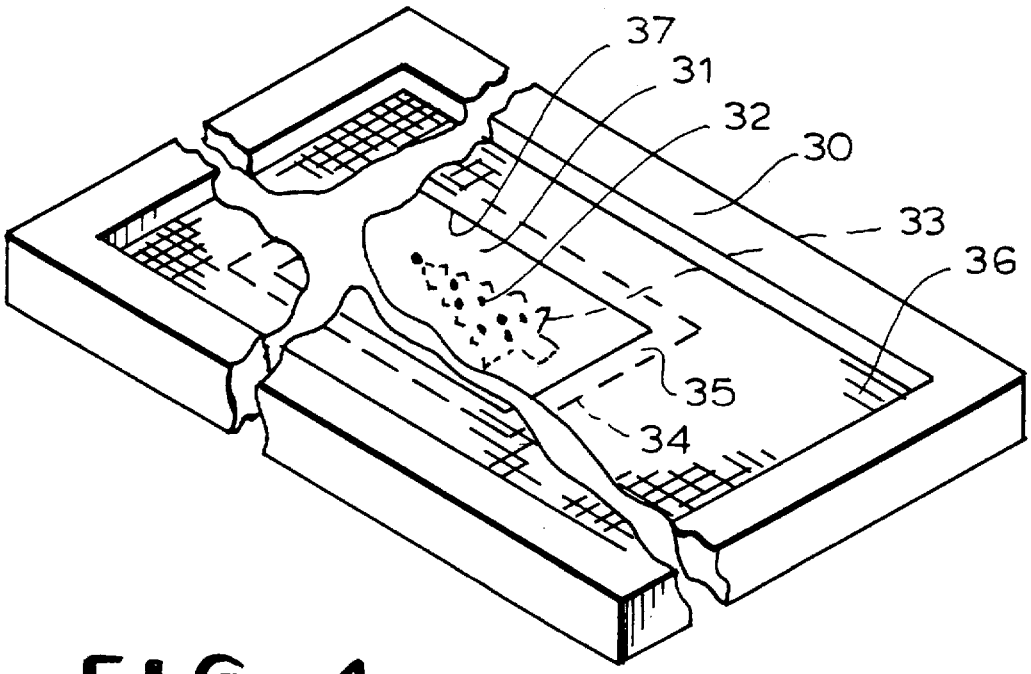
FIG. 4

FIG. 6
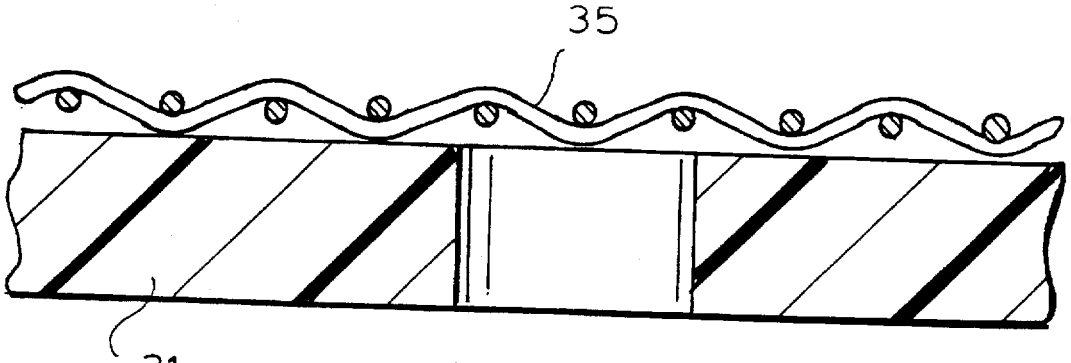
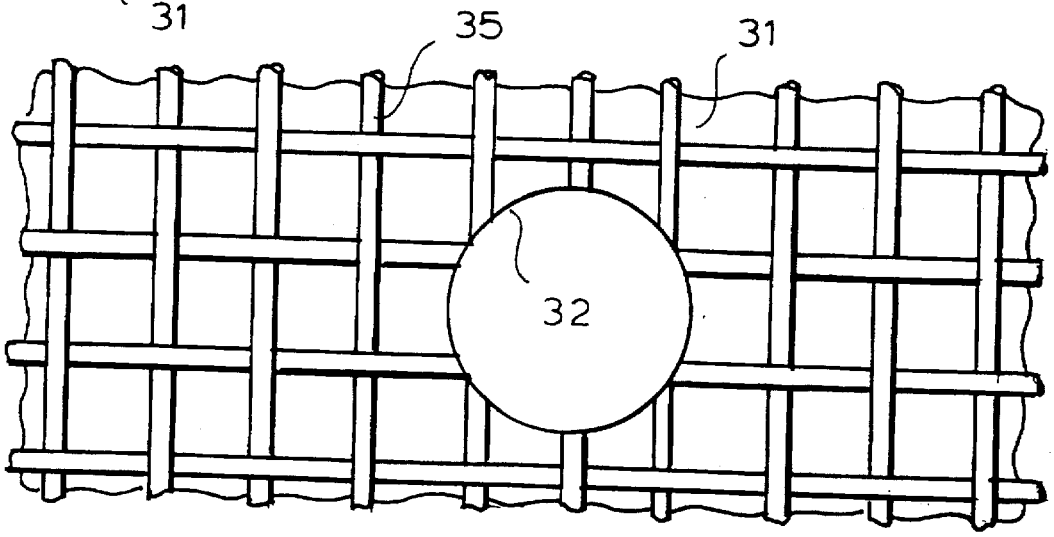
FIG. 7
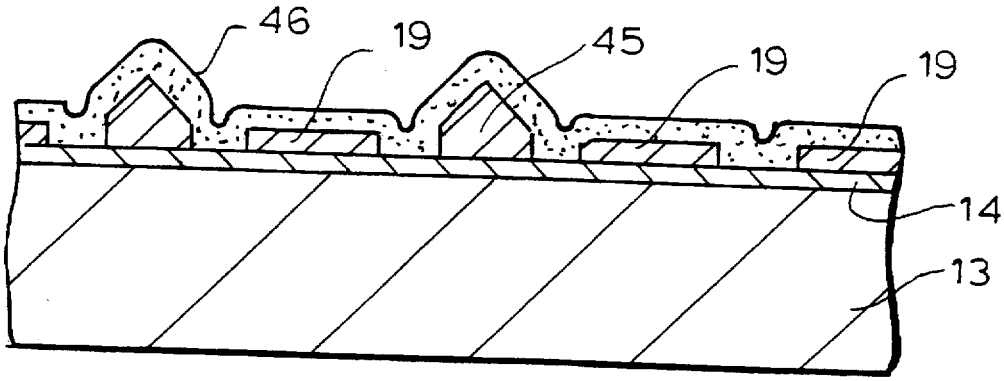
FIG. 9

RELIEF DECORATING OF CERAMIC ARTICLES USING SCREEN PRINTING PROCESSES

BACKGROUND AND SUMMARY OF THE INVENTION

The present invention is directed to the art of relief decorating of ceramic articles, such as porcelains, earthenware, china, ceramic tile and the like.

One of the known techniques for the decoration of ceramic articles involves the use of transfer decals. A desired design is imparted to the transfer decal, typically by screen printing processes, utilizing special ceramic inks. The designs thus printed on the transfer decals are later transferred by known and conventional procedures to the surface of the ceramic article being decorated and adhered to the surface thereof. The ceramic article, with the transferred design, is then fired in a kiln at high temperatures, causing the ceramic inks to be permanently fused onto the surface of the ceramic article.

Conventional screen printing techniques, utilized for the purposes described, are capable of imparting relatively complex and precise designs to the ceramic article. However, the designs thus provided are essentially two-dimensional in nature, in that the ink layer applied to the transfer decal is quite thin.

For many higher quality ceramic articles, it is desired to impart three-dimensional features, or relief, to the overall primary design. In the past, the imparting of such relief features to the primary design of a ceramic article has been carried out manually, by workers utilizing a paint brush or other instrument to place deposits of viscous ceramic ink on the article, in a desired relation a previously applied primary design. The manually applied ink, which stands out from the surface of the article, is dried, in order to retain its three-dimensional characteristic. Later, the decorated ceramic article is fired in a kiln, and the inks are fused to the article in a known manner. The manually applied design elements, even after fusing, retain much of their raised characteristic, providing a desirable three-dimensional or relief character to the final design.

While the final result of the relief design, provided by the above described conventional procedures, is largely satisfactory in terms of its appearance in the final product, it is a very labor-intensive procedure, and one which requires highly skilled personnel. In addition, in a given design, the artist may desire numerous points of application of relief features for a single ceramic article, providing equally numerous opportunities for error in the manual deposition of the relief inks, and the possibility of costly wastage.

Notwithstanding the significant economical incentives to do so, the industry has not heretofore developed a successful procedure for accomplishing relief decoration of ceramic articles on a production basis without resorting to manual application of the relief features, as described above.

In accordance with the present invention, a novel and significantly improved procedure is provided for enabling relief decoration of ceramic articles to be accomplished, utilizing relatively high speed, high precision screen printing techniques, eliminating altogether the need for manual application. In general, one particularly advantageous form of the new process involves the initial preparation of a transfer decal using one or more conventional screen printing processes to apply a conventional, two-dimensional screen-printed primary design, all in accordance with generally well known techniques. Thereafter, a relief decoration is applied to the same decal by means of a special, unique screen printing step, to apply thick, flow resistant ceramic ink to the decal surface in predetermined locations, accurately registered with the previously screen-printed primary design. In this final, modified screen printing operation, special techniques are employed to deposit a heavy, Newtonian-type or thixotropic ceramic ink of a thick, normally flow resistant nature, to the decal surface. The thickness of the relief printing deposits can be quite substantial, standing well above the level of the primary design. After each screen printing stage, the ink is dried, and after the final (relief) printing and drying, a cover coat is applied over the entire decal design, this latter step being conventional practice in the trade and serving to maintain the entire design intact during transfer thereof from the surface of the decal paper to the surface of the ceramic article being decorated.

In some instances, it may be desired to apply the primary design to the article by hand painting techniques, to impart greater individuality to the decorated pieces, or possibly by a separate decal. In such cases, the relief features alone can be applied to a transfer decal sheet, enabling the relief features to be deposited on the decorated article in a single operation. In this respect, the relief features for a single design may well comprise a large number of separate deposits of thick, viscous ink, and significant production economies and labor savings may be realized in applying such relief features by way of a transfer decal, in accordance with the principles of the invention.

For a more complete understanding of the above and other features and advantages of the invention, reference should be made to the following detailed description of preferred embodiments and practices of the invention and to the accompanying drawings.

DESCRIPTION OF THE DRAWINGS

FIG. 1 is a plan view showing a representative form of ceramic plate decorated pursuant to the process of the invention.

FIG. 2 is a highly simplified perspective view of a portion of a conventional screen printing screen for imparting a flat design to a transfer decal sheet, as a preliminary step in the process of the invention.

FIG. 3 is a highly enlarged, fragmentary cross sectional view illustrating the structure of design elements in the printing screen of FIG. 2.

FIG. 4 is a highly simplified and representative partial perspective view of an advantageous form of printing screen used in the process of the invention for imparting relief decoration to a transfer decal sheet, typically in registry with a previously applied primary design.

FIG. 6 is a highly enlarged, fragmentary cross sectional view of a modified form of printing screen which can be utilized in the process of the invention for applying relief decorative features.

FIG. 7 is a top plan view of the screen section of FIG. 6.

FIG. 9 is a highly enlarged fragmentary cross sectional view of a section of transfer decal sheet after printing of primary design and relief features in accordance with the invention, prior to transfer to the surface of a ceramic article to be decorated.

DESCRIPTION OF PREFERRED EMBODIMENTS

Figure 5:
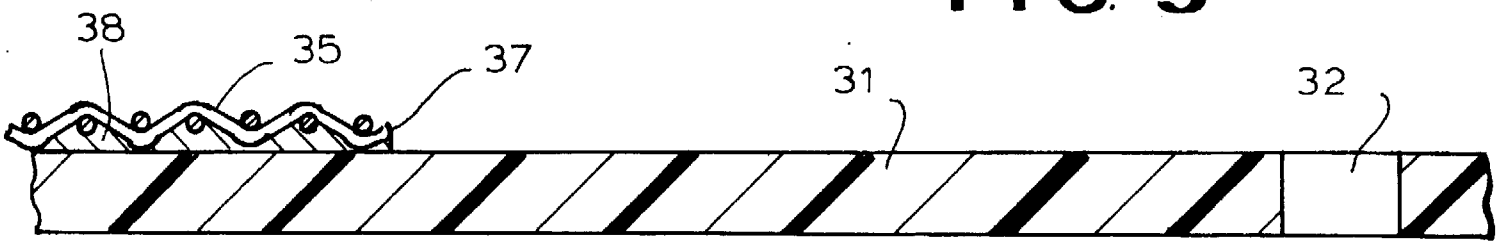
FIG. 5 is a highly enlarged, fragmentary cross sectional representation of the printing screen of FIG. 4.

Referring now to the drawings, the reference numeral 10 (FIG. 1) illustrates a typical item of ceramic dinnerware provided with a decoration, including a primary design element 11 and relief elements 12. In a typical process for applying the primary design element 11 to the surface of the plate 10, a design of suitable ceramic inks is applied to the surface of a transfer decal sheet, typically by way of a screen printing process, all of which is well known in the relevant trade. Prior to the present invention, the decoration applied by transfer decal has been of a substantially flat, two-dimensional character, which is suitable for many purposes. Where higher quality decorative effects are desired, however, the artist may choose to add three-dimensional or relief features to the primary design 11. In the specific illustration of FIG. 1, the primary design feature 11, applied by transfer decal, may be of an evergreen tree, for example, which the artist desires to enhance by locating numerous three-dimensional relief elements 12 colored differently from the primary design of the tree itself and projecting outward from the surface of the plate 10 a sufficient distance to be readily visible as three-dimensional features and readily discernable to the touch.

In the process as heretofore practiced, following transfer of the primary design element 11 to the article 10 from the transfer decal, the relief design elements 12 have been individually placed in position on the primary design feature 11 by manual means, such as paint brushes or other suitable instruments capable of depositing relatively thick ceramic ink onto the surface of the plate. Under the best of circumstances, such relief decoration is a labor-intensive task, requiring the attentive efforts of skilled workers. The task is made even more difficult in some cases where the relief features must be placed in accurately predetermined register with the primary design, either for compliance with the requirements of the designer, or in some cases to avoid contact between inks of a different color, which in certain cases can result in undesired effects in the final product.

After completion of the decorating process, the ceramic article 10 is fired at high temperature in a kiln to fuse the ceramic components of the ink to the article 10, forming a permanent design.

In accordance with the present invention, it becomes possible for the first time to apply the relief elements 12 by way of a screen printing the elements directly onto the surface of the transfer decal sheet, to become an integral part of the transferable design. This enables the entire design, including the primary, two-dimensional design features and the three-dimensional relief features, to be applied to the article 10 in a single operation as a single transfer decal. As will be readily apparent, the achievement of this long-sought objective not only eliminates many laborious and costly manual operations heretofore required, but simultaneously assures precise registry of the primary and relief design elements, providing article-to-article consistency of the design and reliably avoiding any overlap of design elements, where that is a requirement.

In carrying out the process of the invention, generally conventional flat bed screen printing equipment may be employed. Such equipment is well known to those skilled in the art and is readily available from commercial manufacturers thereof. U.S. Pat. No. 3,795,189 is an example of one form of such flat bed press.

In an advantageous process according to the invention, primary and relief designs are printed in separate operations on the surface of a sheet of transfer decal paper 13 (FIG. 9), often referred to as water slide paper. The water slide decal papers utilized for this purpose are generally well known and are commercially available. Acceptable types of such water slide decal papers are sold under the brand names DECAFLAT and TWINCAL II, by Brittains Limited, and META 2000, META 190 and DUX, by Hoffmann & Engelman. These papers are dimensionally stable and resistant to curl over a wide range of temperatures in humidity to enable accurate register in multiple printing operations. The papers are formed with a gum surface coating 14 which accepts the ceramic decorating inks. When the decal paper is soaked in water, the gum base softens and allows the decal design to separate from the underlying sheet, and also provide for initial adhesion of the design to the surface of the article on which it is placed.

The initial printing operation, to impart a generally two-dimensional primary design to the transfer decal sheet, is performed using conventional screen printing techniques. A printing frame 15 (FIG. 2) mounts a screen 16, typically of a fine mesh stainless steel or polyester material. Conventionally, the screen fabric is of 275–400 mesh, with a typical thread diameter in the range of about 0.0010"–0.0014" and an overall thickness of typically 0.0022"–0.0026". The screen is maintained under substantial tension on the frame 15. Typically, tensions of 16–32 N/cm are employed.

A printing stencil 17 (FIG. 3) is formed on the underside of the screen 16. Using conventional procedures, a photosensitive polymer material is coated onto the undersurface of the screen 16 (direct method) or a preformed film of the photosensitive material may be bonded to the screen using an applied thin layer of the same material as a bonding agent (direct-indirect method). In either case, the total thickness of the screen 16 and stencil material 17 typically will be in the range of 0.0025"–0.0050". The photosensitive polymer is exposed under intense light to a "positive" of the intended primary design, which is held in contact with the polymer. The exposed portions of the polymer material are rendered water insoluble, while the unexposed portions remain soluble in water. The stencil is then "developed" by exposure to high pressure water sprays, which remove the areas of water-soluble polymer.

In a typical commercial operation, the developed printing screen, designated generally by the numeral 18 in FIG. 2, will include multiple repeats of a given design 19 such that, in a single printing operation, a transfer decal sheet may be printed with a plurality of decals.

The substantially conventional procedures described above for printing of the primary design allow for the printing of a primary design of a relatively complex and intricate character. After printing of the primary design 19, the transfer decal sheet is conveyed through a heater to dry and set the ink which has been applied. In the process of the present invention, the inks are ceramic inks, formulated by a mixture of medium, frits and stains. In the initial drying stage, the inks are merely dried sufficiently to enable the sheets to be handled and processed for additional printing operations.

If desired, more than one "conventional" screen printing step may be applied to the transfer decal sheet 13, as where the primary design is comprised of elements of different color.

Pursuant to the invention, the final stage of the process comprises the application, by screen printing techniques, of three-dimensional or relief features of a thick, flow resistant ceramic ink, capable of being accurately deposited onto the surface of the decal transfer sheet at levels of thickness far exceeding those of the primary design, so as to stand out significantly from the surface of the transfer sheet.

FIG. 3 of the drawing illustrates a particularly advantageous form of screen and stencil for use in the application of the relief design features. A frame 30 is provided, which in general corresponds to the frame 15 used in the conventional printing steps. In the form illustrated in FIG. 4, a relief stencil 31 is provided in the form of a solid, smooth flat plate formed of metal, such as stainless steel, nickel or brass, or of structural plastic, such as high density polyethylene, polyester, styrene or mylar. The relief stencil is provided in a substantial thickness, typically in the range of 0.015"–0.060", and in certain instances as thick as 0.125", and is provided over its surface with through openings 32 defining the relief features to be imparted to the transfer sheet. In the illustration shown in FIG. 4, the primary design is indicated in broken lines and identified by the reference numeral 33, merely to indicate the register of the relief features 32 with the primary design. It is understood, however, that the primary design element is previously applied to the transfer sheet, and the relief stencil 31 plays no part in its application.

As in the case of the earlier printing steps, the stencil 31 may have a number of repeats. These would, of course, correspond to the repeats formed in the screen(s) employed for printing of the primary design elements. The through openings 32 are preferably formed in the stencil 31 by precision machining, typically using computerized machines for precision cutting and location of the openings. In some cases, through openings 32 may be formed in metal relief stencils 31 by etching procedures. In such cases, a photo-resist emulsion is coated onto the stencil plate, and the graphics are photographically transferred thereto. A water-acid solution is utilized to etch away unprotected surface areas, to provide through openings 32 in the desired shape and location. Mechanical forming of the through openings 32 is preferred in most cases, and is necessary in many, to assure straight-sided openings, as reflected in FIG. 5. The etching procedure is generally limited to use in the preparation of stencils in the thinner end of the indicated range. Particularly with stencil sheets of substantial thickness, etching may tend to produce somewhat of an hour glass configuration, with a slight internal constriction in the through opening, which should be avoided. The openings should be non-convergent in a downward direction to avoid any tendency to lift deposits of the flow resistant ink when being separated from the decal sheet after printing.

In the form of the invention shown in FIG. 4, after processing of the relief stencil 31 to form all the necessary through openings 32, the peripheral margins 34 of the stencil are securely bonded to internal marginal areas 35 of a screen 36, as by means of a suitable epoxy adhesive or the like 38. After joining of the screen 36 and relief stencil 31, the screen is secured to the underside of the frame 30, under high tension, for example on the order of 15–30 N/cm. Typically, the fabric of the screen 36 is kept intact until the screen is tensioned and mounted on the frame 30. Thereafter, the center area of the screen can be cut away and removed to expose the upper surface of the relief stencil, forming the structure shown in FIG. 4.

Another alternative procedure for constructing the relief stencil screen, reflected in FIGS. 6 and 7, is to bond the screen material over the full surface of the sheet material of the relief stencil 31, and machine away the screen material and the sheet metal material simultaneously while forming the through openings 32.

In both of the stencil forms illustrated in FIGS. 5–7, a significant characteristic feature of the stencil is that the openings for the passage of the relief printing inks pass completely through the stencil and are not overlaid by the stencil-mounting screen. This enables the extremely thick and flow resistant relief printing inks to be forced into the through opening and into contact with the sheet to be printed.

In either of the stencil forms illustrated in FIGS. 5–7, it is not necessary to use the extremely fine screens employed for the conventional, two-dimensional primary design. Stainless steel or polyester screens of a 60–90 mesh construction are suitable and desirable, and typically these will have a thickness in the range of 0.008"–0.010". In the case of the alternative stencil form illustrated in FIGS. 6 and 7, the thickness of the screen forms part of the total thickness of the stencil, whereas in the stencil form shown in FIG. 5, the total thickness of the stencil is the thickness of the stencil sheet 31.

In limited circumstances, it may be possible to employ an extremely coarse mesh screen, which remains over the openings in the stencil below. In this respect, given a sufficiently open mesh, with certain inks and with certain designs it may be acceptable to force the ink through an intact screen of a very large mesh. In such cases, it would be possible to construct the stencil using photosensitive polymer sheets, formed by the direct-indirect procedure heretofore described, with the photosensitive polymer bonded to the underside of the screen. In general, this procedure would be limited to the constructions of relief printing stencils in the thinner end of the specified range.

Ceramic inks employed in the process of the invention are formulated from known and commercially available components, available from sources such as Cerdec AG, Frankfurt, Germany and Cookson Matthey, Downingtown, Pa. The inks employed are a mix of medium, frits and stains, with particular mixtures varying from job to job. For conventional screen printing of these ceramic inks, the inks are prepared to a relatively low viscosity, easily flowable through a fine mesh screen. For carrying out relief printing operations according to the invention, on the other hand, the inks are extremely thick and viscous, and can be subjectively described as having a consistency of peanut butter. More objectively, the inks are formulated to have a viscosity well in excess of one million cps. The components of the ink are thoroughly blended and then milled between rollers to a uniform, fine particle size (Hegman 1–2).

Ceramic inks used in the relief printing operations according to the present invention are flow resistant, and must be forced through the stencil openings. Accordingly, screen printing operations utilizing this ink must be carried out differently than conventional operations. For most consistent results, the screen prepared for relief printing should be of the type shown in FIG. 5, where the upper surface of the stencil is completely exposed in the areas to be printed, or as shown in FIGS. 6 and 7, where the stencil opening is formed in the screen as well as the stencil itself, so as to allow unimpeded passage of the ink. This is in contrast to the form of stencil shown in FIG. 3, for conventional, two-dimensional printing, where the more readily flowable inks pass through the screen mesh and then into the stencil opening. In limited cases, however, using unusually large mesh screen, it may be possible to force the flow resistant relief printing inks through the screen and into the stencil openings.

In addition to the utilization of special inks and stencils for the relief printing operations, it is also advantageous to carry out the screen printing process in a modified manner. In conventional screen printing, a flat bar is passed over the surface of the screen to spread a uniform layer of ink over the screen. This is followed by passage of a squeegee element, which is pressed downward against the upper surface of the screen and drawn longitudinally over the screen surface. The highly tensioned screen, which is normally positioned spaced above the surface of the sheet being printed. However, the downward pressure of the squeegee temporarily deflects limited areas of the screen downward and into contact with the surface to be printed while causing the ink to flow through the screen, and through any openings in the stencil below, onto the surface of the article being printed. The squeegee element normally travels at a relatively rapid rate, for example, 12–24 inches per second. Because of the highly tensioned structure of the screen, deflected areas thereof are retracted from the surface of the sheet almost instantly, after passage of the squeegee leaving the ink on the surface of the sheet.

Figure 8:
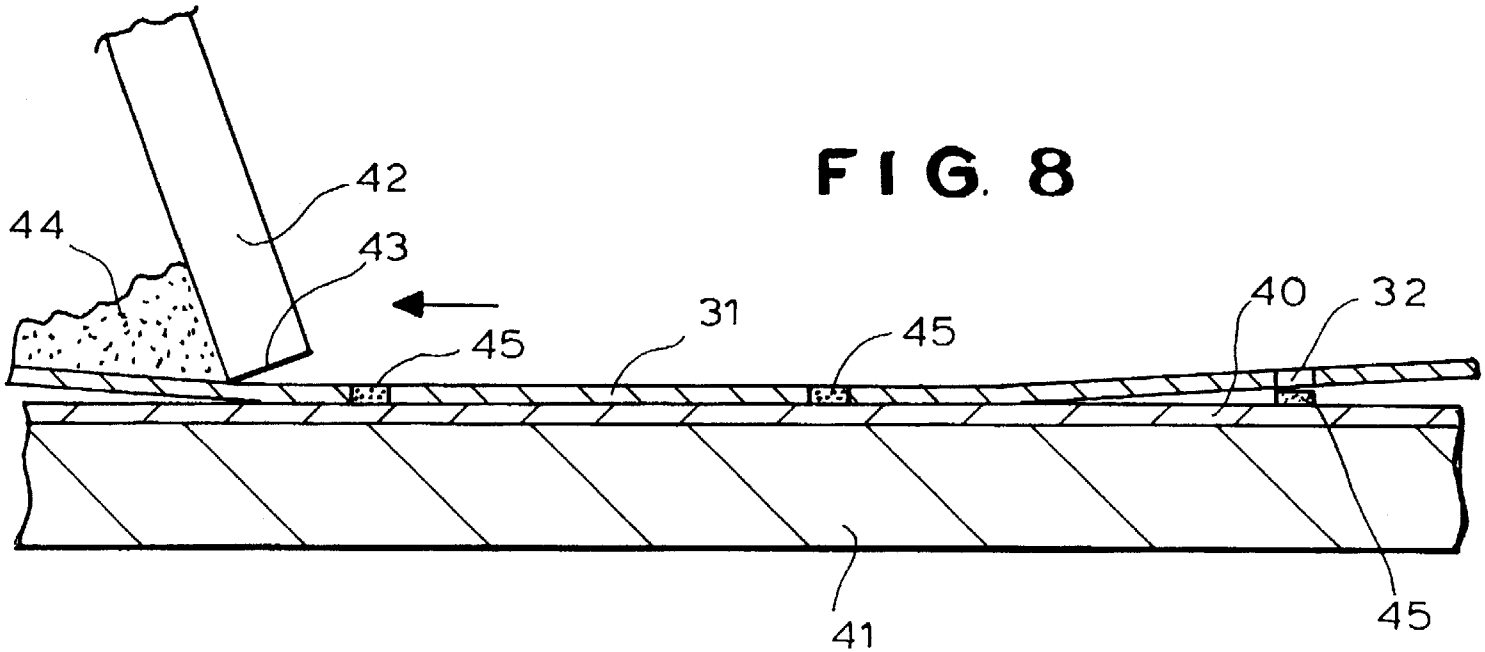
FIG. 8 is a highly enlarged cross sectional representation illustrating the application of relief graphic features onto the surface of a transfer decal sheet in accordance with principles of the invention.

In the process of the present invention, because of the extremely thick and flow resistant character of the relief inks, it is desirable to provide a greater contact interval between the ink and the sheet being printed, before the stencil is retracted away from the sheet. This is accomplished by means of certain modifications to conventional practice. With reference to FIG. 8 of the drawing, the stencil 31, carried by a highly tensioned printing screen, is normally supported in a position elevated slightly above the surface of a transfer decal sheet 40 to be printed with a relief design. A support bed 41, forming part of the printing machine, underlies and supports the decal paper during the printing operation.

A squeegee element 42, which is formed of a resilient material having a durometer in the range of 70–80, is shaped with a square end 43 and is preferably disposed at a slight angle of 10°–15° to the vertical. The squeegee is arranged to be pressed downward with considerable force against the surface of the stencil 31, while being advanced along the surface of the stencil, moving to the left in the illustration of FIG. 8.

Prior to the advance of the squeegee 42, a flooding bar (not shown) distributes a layer of ink over the entire surface of the stencil. As the squeegee advances, the stencil is deflected downward, against the surface of the paper 40, and the thick ceramic ink 44, accumulating along the leading face of the squeegee, is forced through the through openings 32 and into contact with the upper surface of the transfer sheet.

In a procedure according to the invention, it is advantageous to cause the squeegee 42 to travel at a significantly reduced speed, for example, in the range of 0.5–3 inches per second, as compared to speeds in the range of 12–24 inches per second for conventional printing of ceramic inks. Additionally, the screen printing press is adjusted to have a significantly smaller than normal clearance between the bottom of the undeflected stencil and the upper surface of the transfer sheet 40. This causes the stencil to be pressed against the surface of the transfer sheet at a shallower angle than is normal, which tends to delay lifting of the stencil off of the transfer sheet after passage of the squeegee, as is schematically reflected in FIG. 8. The arrangement is such as to provide a "dwell" time of the stencil against the transfer sheet of as much as 1–2 inches after passage of the squeegee. This dwell period, in conjunction with the slower movement of the squeegee itself, provides significantly greater than normal time for the ink deposits, shown at 45 in FIG. 8 to be forced into the stencil openings 32 and to bond with the surface of the transfer sheet reliably, so as to remain on the sheet as the stencil is lifted.

Because of the flow resistant character of the relief printing inks, the printed feature will stand out from the surface of the transfer sheet for the full thickness of the stencil. The ink is formulated so as to substantially prevent crawling, creeping, distorting or changing of its dimensions as established during the printing operation. As the stencil is withdrawn, however, there can be an element of frictional adhesion between the sidewalls of the through openings and the deposited ink 45, and this may elevate portions of the deposit somewhat. To the extent this occurs, it typically is eliminated later on, after the design has been applied to a ceramic article and the article is heated in a kiln for fusing the inks to the ceramic article. During the fusing operation, there is a natural rounding off of edges of the three-dimensional deposits.

After completion of the relief printing operation, the surface of the transfer sheet 13, at least in the areas printed, is coated over its surface with a cover coat 46 (FIG. 9), which forms a continuous layer over the two-dimensional ink deposits 19 of the primary design, and the three-dimensional deposits 45. The cover coat 46, which is transparent and preferably clear, but may be colored, forms a continuous medium which temporarily bonds together all of the design features on the surface of the transfer sheet. The cover coat 46 is formed of a relatively strong, flexible organic polymer, materials which are well known in the trade for the purpose. After deposit of the cover coat, it is dried at a relatively low temperature, typically in the range of 80°–120° F.

When applying the design to an article, such as the dinnerplate 10, the individual printed designs are cut from the printed decal sheet, and an individual decal is soaked in water, typically for one to two minutes at 70°–90° F. This softens the gum layer 14 and allows the entire decal, which is at this stage held intact by the flexible cover coat 46, to be slid off of the underlying sheet. The decal is transferred onto the surface of the plate 10, and properly located on the surface of the plate. The decal is then pressed with a soft squeegee to remove any residual water from underneath its surface. The residue of the gum layer 14 serves to provide a temporary adherent to the surface of the plate.

Figure 10:
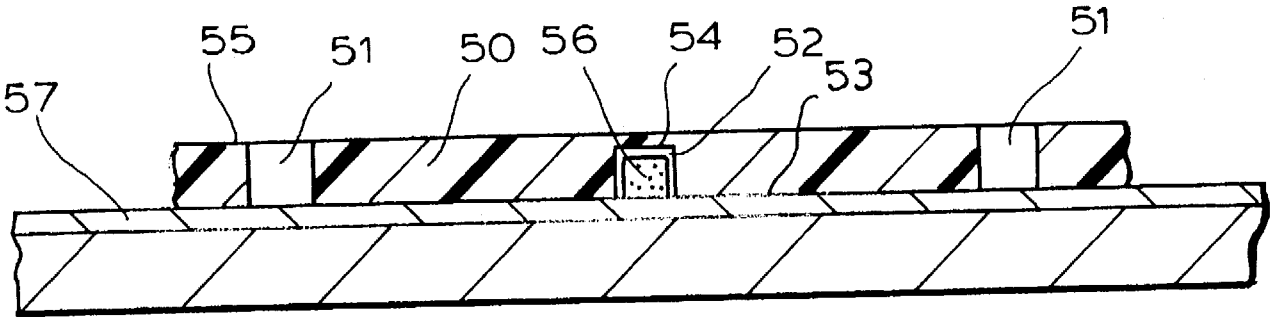
FIG. 10 is an enlarged, fragmentary cross sectional view illustrating a modified form of a machined stencil for printing of relief elements in multiple colors.
Figure 11:
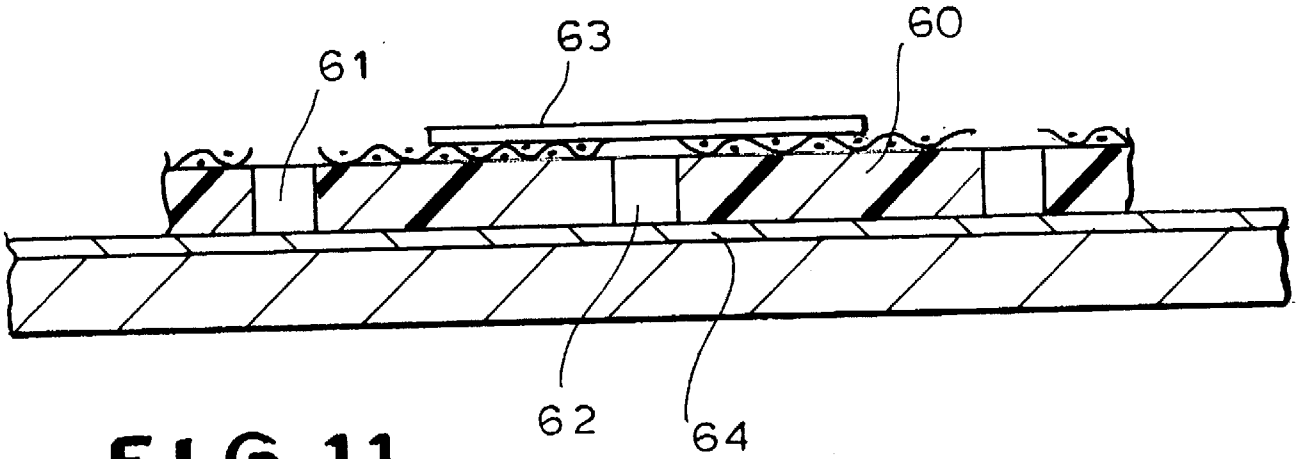
FIG. 11 is an enlarged, fragmentary cross sectional view of a relief printing stencil, prepared by exposure of photosensitive polymers, as modified for use in multi-color relief printing.

After completion of the transfer, the thus decorated article is fired at high temperature, typically at temperatures of around 1400°–1500° F., for 10–30 minutes. During the firing process, the organic components of the decal burn off, leaving only the ceramic components, which fuse to the surface of the article 10. In the fusing process, any sharp-edged features of the elevated relief printing deposits tend to smooth out and become rounded.

Where it is desired to utilize relief printing in accordance with the process of the invention utilizing relief deposits of more than one color, this can be accommodated by the utilization of specially modified stencils, illustrated schematically in FIGS. 10 and 11. In FIG. 10, for example, there is shown a plastic sheet stencil 50 formed with a first plurality of through openings 51 and a second plurality of blind recesses 52, which are open at the bottom surface 53 of the sheet stencil and extend to a level 54 which is close to but spaced from the upper surface 55 of the stencil. All of the through openings 51 correspond to locations for the desired deposit of a relief decoration of one color. All of the downwardly opening recesses 52 correspond to locations in which its relief deposits 56 of another color have already been placed on the decal sheet 57.

In the process illustrated in FIG. 10, the printing of relief decoration is carried out in two steps. In the first step, a regular stencil of the type shown in FIG. 5 may be employed, provided with through openings in all of the locations corresponding to the blind recesses 52 of FIG. 10. In this operation, all of the relief deposits 56 of a first color, will be placed. In a subsequent operation, the illustrated stencil 50 is employed. The existing relief deposits will be received within the blind recesses 52, and new deposits of a second color, will be deposited in the manner previously described herein by way of the through openings 51.

FIG. 11 illustrates an alternative arrangement for the application of relief printing of more than one color to a ceramic article. In the arrangement of FIG. 11, various forms of stencils may be employed, including the stencil form of FIGS. 6 and 7, and even in appropriate cases a further stencil form utilizing very large mesh screen, in which the screen overlies the entire upper surface of the stencil. In the arrangement of FIG. 11, as many stencils can be prepared as there are colors to be deposited in the relief printing steps. Assuming a two-color printing, two stencils of the type shown at 60 in FIG. 11 can be prepared, each with the identical design formed therein by way of a multiplicity of through openings 61, 62. All of the through openings 62, intended for the deposit of one of the two colors, are covered over by means of a suitable adhesive tape 63, to form one of the stencils. A companion stencil is prepared, in which the openings 62 remain uncovered, and tape 63 is applied over all of the openings 61.

The procedure employed with the stencils of FIG. 11 is the same as that described in connection with FIG. 10. A first stencil is employed to apply one of the colors through the untaped openings 61. The areas aligned with the taped-over openings 62 remain free of ink. In a subsequent printing step, using a second stencil in which the opening 61 are taped over and the openings 62 are exposed, the previously deposited relief elements are received in the openings 61, while ink of a second color is deposited on the stencil sheet 64 through the openings 62.

For a limited printing run, the arrangement of FIG. 11 could be carried out using a single stencil, printing the entire run with one of the sets of openings 62 taped over, and then reconstituting the same stencil by removing tape from the openings 62 and taping over the opening 61.

The procedure of the invention makes it possible for the first time to produce relief decorated ceramic ware on a semi-automated basis, in which the three-dimensional relief elements of the design are applied by screen printing procedures to a transfer decal sheet and applied to the ceramic ware by means of the transfer decal. While it has been conventional, for many years, to apply the two-dimensional, primary design features to the article by way of transfer decal procedures, it has always been found necessary to resort to labor intensive, costly manual procedures for placement of the three-dimensional relief features. In even a simple relief decoration, such as a bush with berries, there may be thirty or more individual deposits of relief elements (i.e., the berries) which in the past have had to be placed one at a time with both precisional accuracy and controlled size, shape and quantity of the deposit. With the process of the present invention, all of the relief features can be applied, in effect, with a single stroke of the screen press.

In the process of the invention, the formulation of the inks used for relief printing is important in terms of its flow resistant characteristics. The ink should be of an extraordinary thickness, in relation to known screen printing processes, being comparable to a common material such as peanut butter, which will not flow, or distort in response to the action of gravity during and after the printing operation and until the ink is hardened and set somewhat by a subsequent drying process.

Significant to the procedure of the invention is the provision of relief stencils formed with through openings enabling the thick, heavy relief inks to be forced through without significant resistance at the upper surface of the screen. This is most advantageously accomplished by employing a relief stencil of sheet plastic or sheet metal of an appropriate thickness, in the range of 0.015" to 0.060", or perhaps even greater in some instances, in which the design features are formed by machining processes to provide straight-walled, non-convergent stencil openings.

In one particularly advantageous procedure, the sheet stencil is supported at its peripheral edge margins only by a highly tensioned screen, leaving the entire surface of the stencil exposed to accommodate most effective displacement of the highly viscous relief ink material into the through openings in the stencil and into good contact with the surface of the underlying decal sheet. In another advantageous form of the invention, the entire upper surface of the sheet stencil is carried by the highly tensioned screen, but the screen is machined away or otherwise removed in the area directly above the openings in the stencil, so that through openings are formed in the screen-stencil combination. In limited cases, where the screen mesh is large enough it may be left intact over through openings in the stencil sheet, although this may lead to less reliable results. In such cases, the stencil itself may be formed using photosensitive polymers by way of the direct-indirect method.

In the process of the invention, benefits are realized by increasing the normal dwell time of the deposited relief inks on the surface of the decal sheet, prior to the snap-back or lifting of the screen. This is accomplished in part by significantly reducing the speed of the squeegee element, and also positioning the screen closer to the surface of the transfer sheet, to minimize the "off contact angle" of the screen. By increasing the dwell time, there is greater opportunity for the relief inks to become bonded to the underlying sheet sufficiently to remain with the sheet when the stencil retracts.

The procedures of the invention enable the screen printing of relief features which can easily be as great as one hundred times the thickness of conventional two-dimensional printing for this purpose. The procedure enables very significant economies to be realized in the relief decoration of ceramic articles by virtually eliminating what has heretofore been a costly but necessary series of manual operations.

Although the process of the invention has been described in connection with printing of decals incorporating both a two-dimensional primary design and a three-dimensional relief design, it is within the scope of the invention that the relief features alone could be applied to the transfer decal sheet and a plurality of relief features be transferred to the article to be decorated by way of the decal, following a previous application to the article of a primary design by other means, either manually or by separate decal.

It should be understood, therefore, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A process for relief decorating of ceramic articles, which comprises (a) providing on a transfer decal sheet a substantially two-dimensional primary decorative design comprising a first pattern of ceramic ink of a first thickness, (b) by a screen printing process, depositing a secondary relief design on an upper surface of said transfer decal sheet, (c) said secondary design being formed by a screen-printed deposit of ceramic ink of a thick, flow resistant character to a thickness not less than 0.015 inch, using a screen-printing stencil of at least 0.015 inch in thickness, (d) drying the ceramic ink of said secondary design, (e) transferring said primary and secondary designs from said transfer decal sheet to a ceramic article, and (f) heating said ceramic article to fuse said ceramic inks with said article to form a permanent, outwardly projecting relief design on said article.

2. A decorated ceramic article produced in accordance with the process of claim 1.

3. The process of claim 1, wherein (a) design-forming through openings are provided in said stencil, and (b) said through openings are substantially non-convergent in a downward direction.

4. The process of claim 3, wherein (a) said flow resistant ceramic ink is forced through said design-forming openings by a resilient squeegee moving over the surface of said stencil, (b) said squeegee being advanced at a rate of not greater than about three inches per second.

5. The process of claim 4, wherein (a) said stencil is mounted on a tensioned screen, (b) said screen is positioned in closely spaced relation with respect to the upper surface of said decal sheet whereby, during a printing operation, a contact length of about one to two inches is provided between said stencil and said upper surface as said stencil is progressively displaced by said squeegee.

6. The process of claim 1, wherein (a) said stencil is formed of a sheet of metal or sheet plastic.

7. The process of claim 6, wherein (a) design-forming openings are provided in said stencil by mechanical machining and are substantially non-convergent in a downward direction.

8. The process of claim 6, wherein (a) said stencil is mounted on a highly tensioned screen maintained under a tension on the order of 15–30 N/cm.

9. The process of claim 8, wherein (a) said highly tensioned screen has an opening in a center portion thereof defined by internal edge margins of said screen, (b) outer peripheral edge margins of said stencil are bonded to said internal edge margins of said screen, and (c) design-forming openings are located in said stencil in the areas thereof bounded by said outer peripheral margins.

10. A process for relief decorating of ceramic articles, which comprises (a) providing a transfer decal sheet, (b) by a screen printing process, depositing a projecting relief design on an upper surface of said transfer decal sheet, (c) said relief design being formed by a screen-printed deposit of ceramic ink of a thick, flow resistant character to a thickness not less than 0.015 inch, (d) drying the ceramic ink of said relief design, (e) transferring said relief design from said transfer decal sheet to a ceramic article, and (f) heating said ceramic article to fuse said ceramic ink with said article to form a permanent, outwardly projecting relief design on said article.

11. A decorated ceramic article produced in accordance with the process of claim 10.

12. A process for relief decorating of ceramic articles, which comprises (a) providing on a transfer decal sheet a substantially two-dimensional primary decorative design comprising a first pattern of ceramic ink of a first thickness, (b) by a screen printing process, depositing a secondary relief design on an upper surface of said transfer decal sheet, (c) said secondary design being formed by a screen-printed deposit of ceramic ink of a thick, flow resistant character to a thickness not less than 0.015 inch, (d) the ceramic ink of said secondary design is formulated to have a viscosity in excess of one million cps, (e) drying the ceramic ink of said secondary design, (f) transferring said primary and secondary designs from said transfer decal sheet to a ceramic article, and (g) heating said ceramic article to fuse said ceramic inks with said article to form a permanent relief design on said article.

13. A decorated ceramic article produced in accordance with the process of claim 12.

14. A process for relief decorating of ceramic articles, which comprises (a) providing on a transfer decal sheet a substantially two-dimensional primary decorative design comprising a first pattern of ceramic ink of a first thickness, (b) by a screen printing process, depositing a secondary relief design on an upper surface of said transfer decal sheet, (c) said secondary design being formed by a screen-printed deposit of ceramic ink of a thick, flow resistant character to a thickness not less than 0.015 inch, (d) drying the ceramic ink of said secondary design, (e) transferring said primary and secondary designs from said transfer decal sheet to a ceramic article, and (f) heating said ceramic article to fuse said ceramic inks with said article to form a permanent relief design on said article, (g) the ceramic ink of said secondary design being applied using a screen-printing stencil formed of sheet metal or sheet plastic of at least 0.015 inch in thickness, (h) said stencil being mounted on a highly tensioned screen maintained under a tension on the order of 15–30 N/cm, (i) said design-forming openings being provided in said stencil by mechanical machining, (j) said stencil being bonded over an entire upper surface thereof to a lower surface of said screen, and (k) openings in said stencil also being formed in said screen.

15. A process for relief decorating of ceramic articles, which comprises (a) providing a transfer decal sheet, (b) by a screen printing process, depositing a relief design on an upper surface of said transfer decal sheet, (c) said relief design being formed by a screen-printed deposit of ceramic ink of a thick, flow resistant character to a thickness not less than 0.015 inch, (d) drying the ceramic ink of said relief design, (e) transferring said relief design from said transfer decal sheet to a ceramic article, (f) heating said ceramic article to fuse said ceramic ink with said article to form a permanent relief design on said article, (g) the ceramic ink of said relief design being formulated to have a viscosity in excess of one million cps, and (h) the ceramic ink of said relief design being applied using a screen-printing stencil of at least about 0.015 inch in thickness provided with non-convergent, design-forming through openings.

16. A decorated ceramic article produced in accordance with the process of claim 15.

17. The process of claim 15, wherein (a) said flow resistant ceramic ink is forced through said design-forming openings by a squeegee moving over the surface of said stencil, (b) said squeegee being advanced at a rate of not greater than about three inches per second.

18. The process of claim 17, wherein (a) said stencil is mounted on a tensioned screen, (b) said screen is positioned in closely spaced relation with respect to the upper surface of said decal sheet whereby, during a printing operation, a contact length of about one to two inches is provided between said stencil and said upper surface as said stencil is progressively displaced by said squeegee.

19. The process of claim 15, wherein (a) said stencil is formed of a sheet of metal or sheet plastic, (b) said design-forming openings are provided in said stencil by mechanical machining, and (c) said stencil is mounted on a highly tensioned screen maintained under a tension on the order of 15–30 N/cm.

20. The process of claim 19, wherein (a) said highly tensioned screen has an opening in a center portion thereof defined by internal edge margins of said screen, (b) outer peripheral edge margins of said stencil are bonded to said internal edge margins of said screen, and (c) said design-forming openings are located in said stencil in the areas thereof bounded by said outer peripheral margins.

21. The process of claim 19, wherein (a) said stencil is bonded over an entire upper surface thereof to a lower surface of said screen, and (b) design-forming openings in said stencil are also formed in said screen.

* * * * *